US010580565B2

(12) United States Patent
Maeda et al.

(10) Patent No.: US 10,580,565 B2
(45) Date of Patent: Mar. 3, 2020

(54) REACTOR INCLUDING FIRST END PLATE AND SECOND END PLATE

(71) Applicant: FANUC CORPORATION, Yamanashi (JP)

(72) Inventors: Takuya Maeda, Yamanashi (JP); Masatomo Shirouzu, Yamanashi (JP); Takafumi Kajiya, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 237 days.

(21) Appl. No.: 15/696,296

(22) Filed: Sep. 6, 2017

(65) Prior Publication Data

US 2018/0068776 A1 Mar. 8, 2018

(30) Foreign Application Priority Data

Sep. 8, 2016 (JP) ..... 2016-175837
Jun. 1, 2017 (JP) ..... 2017-109251

(51) Int. Cl.

| | |
|---|---|
| ***H01F 27/28*** | (2006.01) |
| ***H01F 27/255*** | (2006.01) |
| ***H01F 27/26*** | (2006.01) |
| ***H01F 27/32*** | (2006.01) |
| ***H01F 37/00*** | (2006.01) |
| ***H01F 41/02*** | (2006.01) |

(52) U.S. Cl.

CPC ..... *H01F 27/255* (2013.01); *H01F 27/263* (2013.01); *H01F 27/266* (2013.01); *H01F 27/28* (2013.01); *H01F 27/324* (2013.01); *H01F 37/005* (2013.01); *H01F 41/02* (2013.01)

(58) Field of Classification Search

CPC ..... H01F 27/00–36
USPC ..... 336/65, 83, 90, 92, 192, 210–215, 336/233–234

See application file for complete search history.

(56) References Cited

FOREIGN PATENT DOCUMENTS

| | | | | |
|---|---|---|---|---|
| JP | 61224306 | A | | 10/1986 |
| JP | 200077242 | A | | 3/2000 |
| JP | 2008210998 | A | | 9/2008 |
| JP | 2009094328 | A | * | 4/2009 |
| JP | 2009273280 | A | | 11/2009 |
| JP | 2010252539 | A | | 11/2010 |
| JP | 2015142095 | A | | 8/2015 |
| WO | 2014073252 | A1 | | 5/2014 |

OTHER PUBLICATIONS

English Abstract and Machine Translation for International Publication No. WO2014/073252 A1, published May 15, 2014, 37 pgs.
English Abstract and Machine Translation for Japanese Publication No. 2008-210998 A, published Sep. 11, 2008, 11 pgs.
English Machine Translation and Abstract for Japanese Publication No. 2000-077242 A, published Mar. 14, 2000, 20 pgs.

(Continued)

*Primary Examiner* — Tuyen T Nguyen
(74) *Attorney, Agent, or Firm* — Fredrikson & Byron, P.A.

(57) ABSTRACT

A reactor includes a core body; a first end plate and a second end plate which sandwich and fasten the core body; and a plurality of axis portions disposed in the vicinity of an outer edge portion of the core body or outward of the core body and supported by the first end plate and the second end plate.

12 Claims, 11 Drawing Sheets

(56) References Cited

OTHER PUBLICATIONS

English Abstract and Machine Translation for Japanese Publication No. JPS61-224306 A, published Oct. 6, 1986, 5 pgs.
English Abstract and Machine Translation for Japanese Publication No. 2015-142095 A, published Aug. 3, 2015, 19 pgs.
English Abstract and Machine Translation for Japanese Publication No. 2010-252539 A, published Nov. 4, 2010, 18 pgs.
English Abstract and Machine Translation for Japanese Publication No. 2009-273280 A, published Nov. 19, 2009, 19 pgs.
Untranslated Decision to Grant a Patent mailed by Japan Patent Office (JPO) for Application No. JP 2017-166017, dated Jan. 8, 2019, 3 pgs.
English Machine Translation of Decision to Grant a Patent mailed by Japan Patent Office (JPO) for Application No. JP 2017-166017, dated Jan. 8, 2019, 2 pgs.
Untranslated Notification of Reasons for Refusal mailed by Japan Patent Office (JPO) for Application No. JP 2017-166017, dated Nov. 13, 2018, 4 pgs.
English Machine Translation of Notification of Reasons for Refusal mailed by Japan Patent Office (JPO) for Application No. JP 2017-166017, dated Nov. 13, 2018, 3 pgs.
Untranslated Notification of Reasons for Refusal mailed by Japan Patent Office (JPO) for Application No. JP 2017-166017, dated Aug. 28, 2018, 8 pgs.
English Machine Translation of Notification of Reasons for Refusal mailed by Japan Patent Office (JPO) for Application No. JP 2017-166017, dated Aug. 28, 2018, 5 pgs.

* cited by examiner

REACTOR INCLUDING FIRST END PLATE AND SECOND END PLATE

BACKGROUND OF THE INVENTION

1. Field of the Invention

The present invention relates to a reactor. In particular, the present invention relates to a reactor in which a core body is held between a first end plate and a second end plate.

2. Description of the Related Art

FIG. 8 is a perspective view of a reactor according to a conventional technique as disclosed in Japanese Unexamined Patent Publication (Kokai) No. 2000-77242 and Japanese Unexamined Patent Publication (Kokai) No. 2008-210998. As illustrated in FIG. 8, a reactor 100 includes a substantially E-shaped first iron core 150 including two first outer side leg portions 151, 152 and a first center leg portion 153 disposed between the first outer side leg portions 151, 152 and a substantially E-shaped second iron core 160 including two second outer side leg portions 161 and 162 and a second center leg portion 163 disposed between the second outer side leg portions 161 and 162. The first iron core 150 and the second iron core 160 are formed by stacking a plurality of electrical steel plates. Note that in FIG. 8, a stacking direction of the electrical steel plates is indicated by an arrow.

Further, a coil 171 is wound onto the first outer side leg portion 151 and the second outer side leg portion 161. Similarly, a coil 172 is wound onto the first outer side leg portion 152 and the second outer side leg portion 162, and a coil 173 is wound onto the first center leg portion 153 and the second center leg portion 163.

FIG. 9 is a diagram illustrating the first iron core and the second iron core of the reactor illustrated in FIG. 8. In FIG. 9, for the sake of clarity, illustration of the coils is omitted. As illustrated in FIG. 9, the two first outer side leg portions 151, 152 of the first iron core 150 respectively face the two second outer side leg portions 161 and 162 of the second iron core 160. Further, the first center leg portion 153 and the second center leg portion 163 face each other. Then, between the leg portions, a gap G is formed.

SUMMARY OF INVENTION

To form the reactor 100, the first iron core 150 and the second iron core 160 are to be coupled to each other. In addition, because the first iron core 150 and the second iron core 160 are formed by stacking a plurality of electrical steel plates, noises and vibrations may be generated while the reactor drives. In view of such a point as well, the first iron core 150 and the second iron core 160 are desirably coupled to each other.

However, since the gap G is to be formed, the first iron core 150 and the second iron core 160 cannot be directly coupled to each other. Accordingly, the first iron core 150 and the second iron core 160 are to be coupled to each other while the gap G is maintained.

FIG. 10 is an enlarged side view of the gap. In FIG. 10, to configure the reactor 100, the outer side leg portions 151 and 161 are coupled to each other by coupling plates 181 and 182. It is assumed that similarly, the other leg portions are configured as well. However, in such a case, a configuration of the reactor 100 becomes complicated. As a result, it is difficult to control a gap length which influences the inductance. In addition, when the coupling plates 181 and 182 are made of a magnetic material, leakage of magnetic flux occurs, which is unfavorable.

The present invention has been made in view of such circumstances and has an object to provide a reactor which can suitably support a core body while leakage of magnetic flux fails to occur.

To achieve the above object, according to a first aspect, there is provided a reactor including: a core body; a first end plate and a second end plate which sandwich and fasten the core body; and a plurality of axis portions disposed in the vicinity of an outer edge portion of the core body or outward of the core body and supported by the first end plate and the second end plate.

According to a second aspect, in the first aspect, a cross section of the axis portions is polygonal.

According to a third aspect, in the first or second aspect, the axis portions are solid.

According to a fourth aspect, in the first or second aspect, the axis portions are hollow.

According to a fifth aspect, in any one of the first to fourth aspects, the core body includes: an outer circumference portion iron core; at least three iron cores which are in contact with an inner surface of the outer circumference portion iron core or coupled to the inner surface; and coils respectively wound onto the at least three iron cores, a gap which can be magnetically coupled is formed between two iron cores adjacent to each other from among the at least three iron cores or between the at least three iron cores and a center portion iron core disposed at a center of the core body, and the plurality of axis portions penetrate an interior of the outer circumference portion iron core or are disposed outward of the outer circumference portion iron core.

According to a sixth aspect, in any one of the first to fifth aspects, at least one of the first end plate and the second end plate is provided with an opening portion, and the coils pass through the opening portion of at least one of the first end plate and the second end plate and protrude further outward than at least one of the first end plate and the second end plate.

According to a seventh aspect, in any one of the first to sixth aspects, at least one of the axis portions, the first end plate, and the second end plate is made of a non-magnetic material.

According to an eighth aspect, in any one of the first to seventh aspects, the first end plate and the second end plate are in contact with the outer circumference portion iron core over an entire edge portion of the outer circumference portion iron core.

According to a ninth aspect, in any one of the first to eighth aspects, a housing which encloses the core body is further provided, in which the plurality of axis portions disposed outward of the outer circumference portion iron core penetrate the housing.

According to a tenth aspect, in any one of the first to fourth aspects, the core body includes: a center portion iron core disposed at a center of the core body; a plurality of iron cores disposed outside the center portion iron core in such a manner that a magnetic path with respect to the center portion iron core has a loop shape; and one or a plurality of coils wound onto the plurality of iron cores, a gap which can be magnetically coupled is formed between the center portion iron core and the plurality of iron cores, and the plurality of axis portions are disposed inside or outside the iron cores.

According to an eleventh aspect, in the tenth aspect, at least one of the first end plate and the second end plate is provided with an opening portion, and the coil passes through the opening portion of at least one of the first end plate and the second end plate and protrudes further outward than at least one of the first end plate and the second end plate.

According to a twelfth aspect, in the tenth or eleventh aspect, at least one of the axis portions, the first end plate, and the second end plate are made of a non-magnetic material.

According to a thirteenth aspect, in any one of the tenth to twelfth aspects, the first end plate and the second end plate are in contact with the outer circumference portion iron core over an entire edge portion of the outer circumference portion iron core.

According to a fourteenth aspect, in any one of the tenth to thirteenth aspects, a housing which encloses the core body is further provided, in which the plurality of axis portions disposed outward of the outer circumference portion iron core penetrate the housing.

Such objects, features, and advantages and other objects, features, and advantages of the present invention will become further clearer from the detailed description of typical embodiments of the present invention which are illustrated in the attached drawings.

BRIEF DESCRIPTION OF THE DRAWINGS

FIG. 11C is a perspective view of an axis portion applied to the reactor illustrated in FIG. 11B and the like.

DETAILED DESCRIPTION

Hereinafter, embodiments of the present invention will be described with reference to the attached drawings. In the following figures, similar members are assigned similar reference signs. To facilitate understanding, these figures are suitably changed in scale.

In the following description, a three-phase reactor will be described by way of example, while application of the present invention is not limited to the three-phase reactor but application can be widely made to a multiphase reactor in each phase of which constant inductance is to be provided. In addition, the reactor of the present invention is not limited to that as provided on the primary side and the secondary side of an inverter in an industrial robot or a machine tool, but can be applied to various devices.

Figure 1:
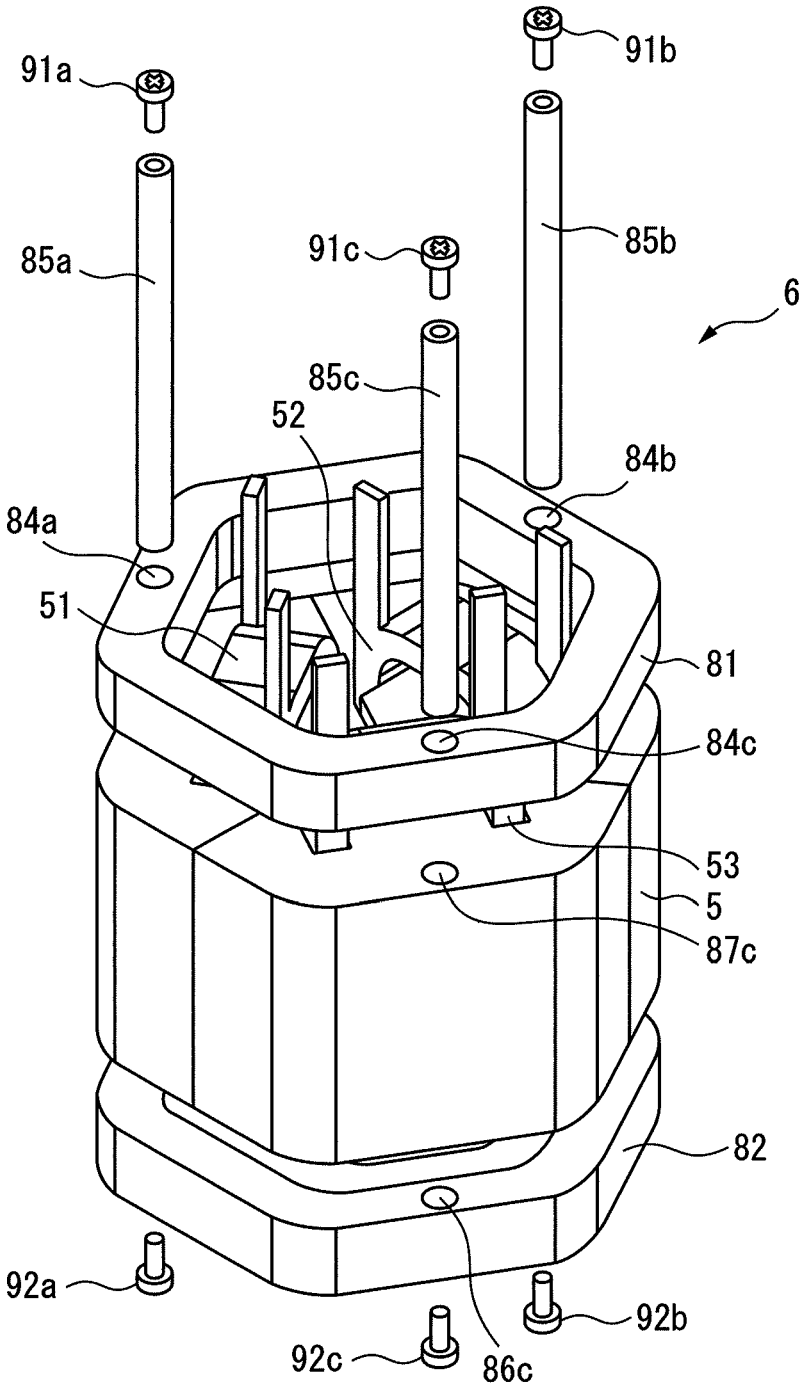
FIG. 1 is an exploded perspective view of a reactor according to the present invention.
Figure 2:
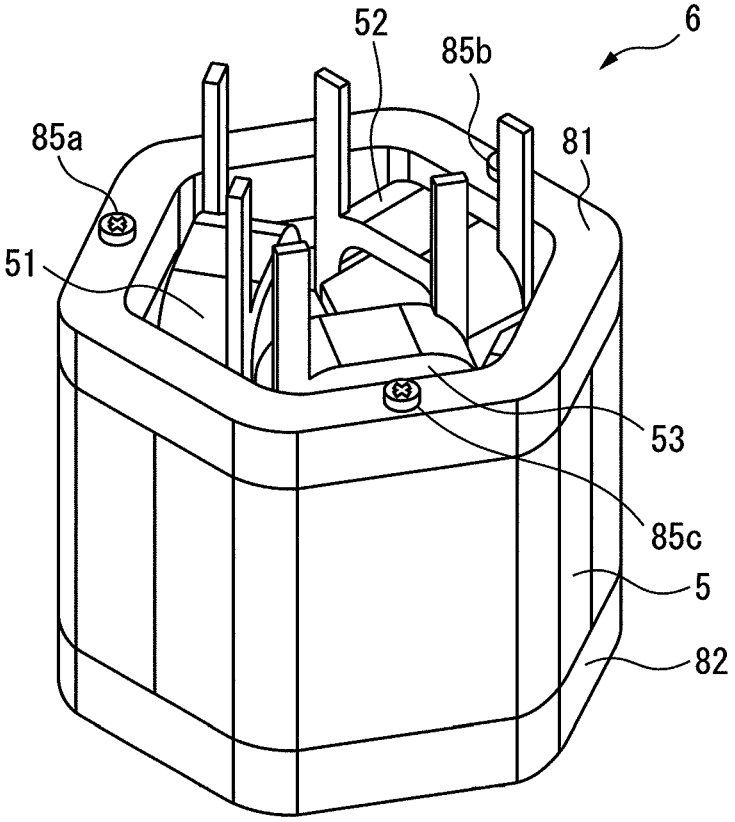
FIG. 2 is a perspective view of the reactor illustrated in FIG. 1.

FIG. 1 is an exploded perspective view of a reactor according to the present invention, and FIG. 2 is a perspective view of the reactor illustrated in FIG. 1. A reactor 6 illustrated in FIGS. 1 and 2 mainly includes a core body 5 and a first end plate 81 and a second end plate 82 which sandwich and fasten the core body 5 in an axial direction. The first end plate 81 and the second end plate 82 are in contact with an outer circumference portion iron core 20 over the entire edge portion of the outer circumference portion iron core 20 of the core body 5 as described below.

The first end plate 81 and the second end plate 82 are preferably made of a non-magnetic material, such as aluminum, SUS, or a resin.

Figure 3:
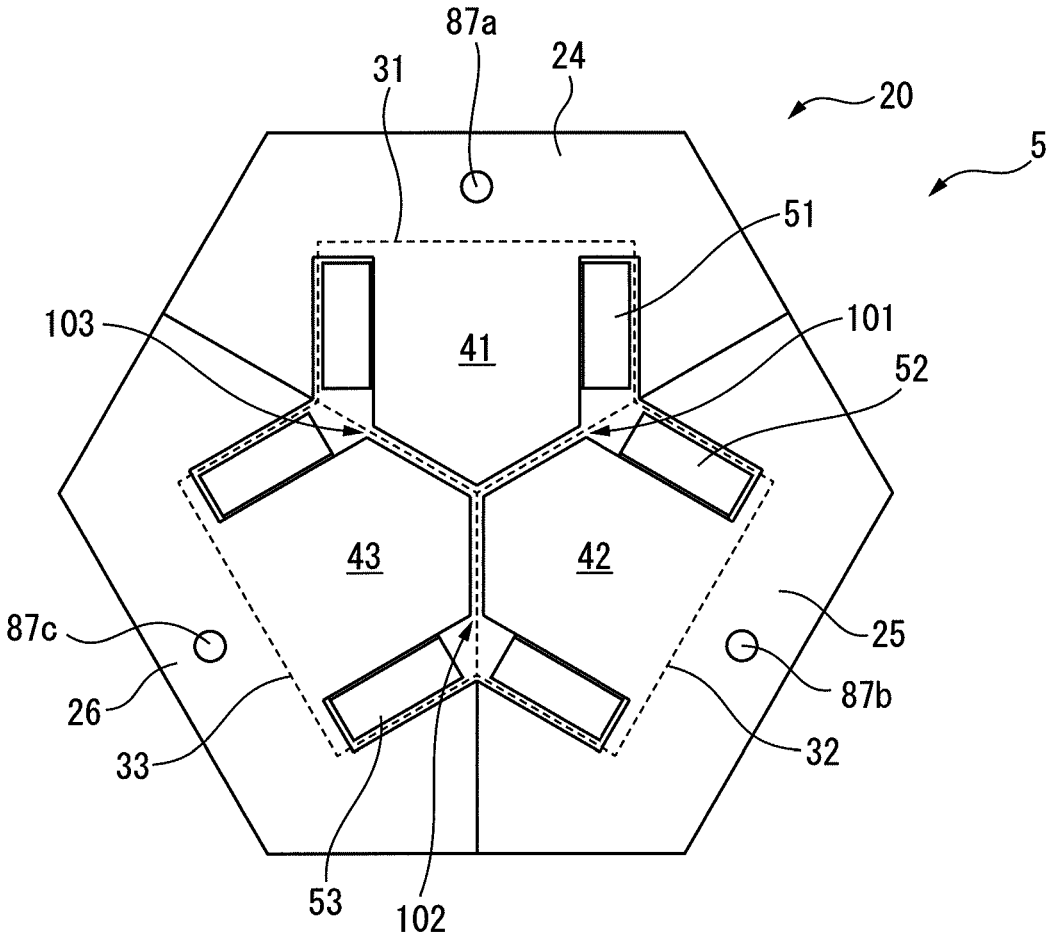
FIG. 3 is a first cross-sectional view of a core body.

FIG. 3 is a first cross-sectional view of the core body. As illustrated in FIG. 3, the core body 5 includes the outer circumference portion iron core 20 and three iron core coils 31-33 which are magnetically coupled to the outer circumference portion iron core 20 in a mutual manner. In FIG. 3, the iron core coils 31-33 are disposed inside the outer circumference portion iron core 20 having a substantially hexagonal shape. The iron core coils 31-33 are disposed at equal intervals in a circumferential direction of the core body 5.

Note that the outer circumference portion iron core 20 may have another rotationally symmetrical shape, such as a circular shape. It is assumed in such a case that the first end plate 81 and the second end plate 82 have a shape corresponding to that of the outer circumference portion iron core 20. In addition, the number of iron core coils only needs to be a multiple of three.

As apparent from the figure, the iron core coils 31-33 respectively include iron cores 41-43 which extend in a radial direction of the outer circumference portion iron core 20 and coils 51-53 which are respectively wound onto the iron cores. A radial direction outer side end portion of each of the iron cores 41-43 is in contact with the outer circumference portion iron core 20 or formed integrally with the outer circumference portion iron core 20.

Note that in FIG. 3, the outer circumference portion iron core 20 is composed of a plurality of portions, for example, three outer circumference portion iron core portions 24-26, which are divided at equal intervals in the circumferential direction. The outer circumference portion iron core portions 24-26 are formed integrally with the iron cores 41-43, respectively. When the outer circumference portion iron core 20 is composed of the plurality of outer circumference portion iron core portions 24-26, even in a case in which the outer circumference portion iron core 20 is large, the outer circumference portion iron core 20 can be easily manufactured.

Further, a radial direction inner side end portion of each of the iron cores 41-43 is positioned in the vicinity of the center of the outer circumference portion iron core 20. In the figure, the radial direction inner side end portion of each of the iron cores 41-43 converges toward the center of the outer circumference portion iron core 20, and a tip end angle thereof is approximately 120°. Then, the radial direction inner side end portions of the iron cores 41-43 are separated from each other with gaps 101-103 therebetween which can be magnetically coupled.

In other words, the radial direction inner side end portion of the iron core 41 is separated from the radial direction inner side end portion of each of the adjacent two iron cores 42, 43 with the gaps 101, 103 therebetween, respectively.

Similarly, the other iron cores 42, 43 are configured as well. Note that it is assumed that sizes of the gaps 101-103 are equal to each other.

Thus, in the present invention, a center portion iron core positioned at a center portion of the core body 5 is not necessary so that the core body 5 can be configured to be light and simple. Further, the three iron core coils 31-33 are enclosed by the outer circumference portion iron core 20 so that a magnetic field generated from the coils 51-53 fails to leak out of the outer circumference portion iron core 20. In addition, the gaps 101-103 can be provided to have any thickness with low costs, which is advantageous in terms of design as compared with reactors having a conventional configuration.

Further, in the core body 5 of the present invention, a difference in magnetic path length among phases becomes small as compared with reactors having a conventional configuration. Thus, in the present invention, an imbalance of the inductance due to a difference in magnetic path length can be reduced as well. In addition, using a coupling plate according to a conventional technique is not necessary so that control of a gap length is easy.

Note that a configuration of the core body 5 is not limited to that as illustrated in FIG. 3. It is assumed that even the core body 5 having another configuration in which a plurality of iron core coils are enclosed by the outer circumference portion iron core 20 is within the scope of the invention.

Figure 4:
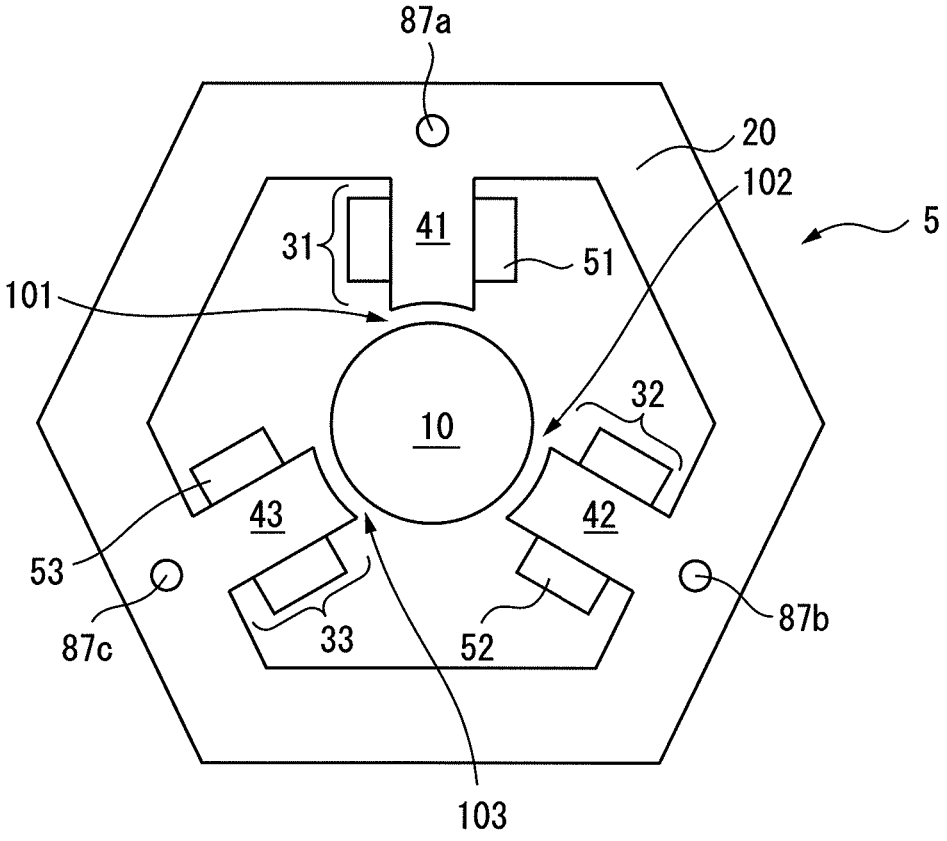
FIG. 4 is a second cross-sectional view of the core body.

For example, the core body 5 as illustrated in FIG. 4 may be employed as well. The core body 5 illustrated in FIG. 4 includes a center portion iron core 10 having a circular shape, the outer circumference portion iron core 20 enclosing the center portion iron core 10, and the three iron core coils 31-33. The iron core coils 31-33 are disposed at equal intervals with respect to each other in the circumferential direction. In FIG. 4, at the center of the outer circumference portion iron core 20 having a substantially hexagonal shape, the center portion iron core 10 is disposed. Between the radial direction inner side end portions of the iron cores 41-43 and the center portion iron core 10, the gaps 101-103 which can be magnetically coupled are formed, respectively.

Note that the center portion iron core 10, the outer circumference portion iron core 20, and the iron cores 41-43 are formed by stacking a plurality of iron plates, carbon steel plates, or electrical steel plates, or made of a dust core. Further, the outer circumference portion iron core 20 may be integral, or alternatively, the outer circumference portion iron core 20 may be dividable into a plurality of small parts.

The iron cores 41-43 extend to the vicinity of an outer circumferential surface of the center portion iron core 10. Further, on the coupling iron cores 41-43, the coils 51-53 are wound, respectively.

In the core body 5 illustrated in FIG. 4, at the center of the outer circumference portion iron core 20, the center portion iron core 10 is disposed, while the iron cores 41-43 are disposed at equal intervals with respect to each other in the circumferential direction. Accordingly, in the core body 5 illustrated in FIG. 4, the coils 51-53 and the gaps in the iron cores 41-43 are also equally spaced with respect to each other in the circumferential direction, and the core body 5 itself has a rotationally symmetrical structure.

Consequently, in the core body 5, typically, magnetic flux concentrates at the center thereof, and in a three-phase alternating current, a total of the magnetic flux at the center portion of the core body is zero. Accordingly, in a configuration illustrated in FIG. 4, there is no difference in magnetic path length among phases, and the imbalance of the inductance due to a difference in magnetic path length can be eliminated. Further, the imbalance of the magnetic flux generated from the coils can be eliminated as well so that the imbalance of the inductance due to the imbalance of the magnetic flux can be eliminated.

In addition, in the configuration illustrated in FIG. 4, steel plates are punched using a die with good accuracy while stacked by caulking and the like with good accuracy, whereby the center portion iron core 10, the outer circumference portion iron core 20, and the iron cores 41-43 can be manufactured with high accuracy. As a result, the center portion iron core 10, the outer circumference portion iron core 20, and the iron cores 41-43 can be assembled to each other with high accuracy, and size control of the gaps can be performed with high accuracy.

In other words, in the configuration illustrated in FIG. 4, the iron cores 41-43 between the center portion iron core 10 and the outer circumference portion iron core 20 can be provided with the gaps having any size with high accuracy at low costs. Thus, in the configuration illustrated in FIG. 4, flexibility in terms of design of the core body 5 is improved, and as a result, an accuracy of the inductance is also improved.

Further, in the configuration illustrated in FIG. 4, the iron cores 41-43 including the coils 51-53 and the gaps are enclosed by the outer circumference portion iron core 20. Thus, in the configuration illustrated in FIG. 4, a magnetic field and magnetic flux fail to leak out to the exterior of the outer circumference portion iron core 20, and high frequency noises can be largely reduced. Note that even a reactor including the core body having another configuration in which the center portion iron core 10 is provided is within the scope of the present invention.

Figure 5:
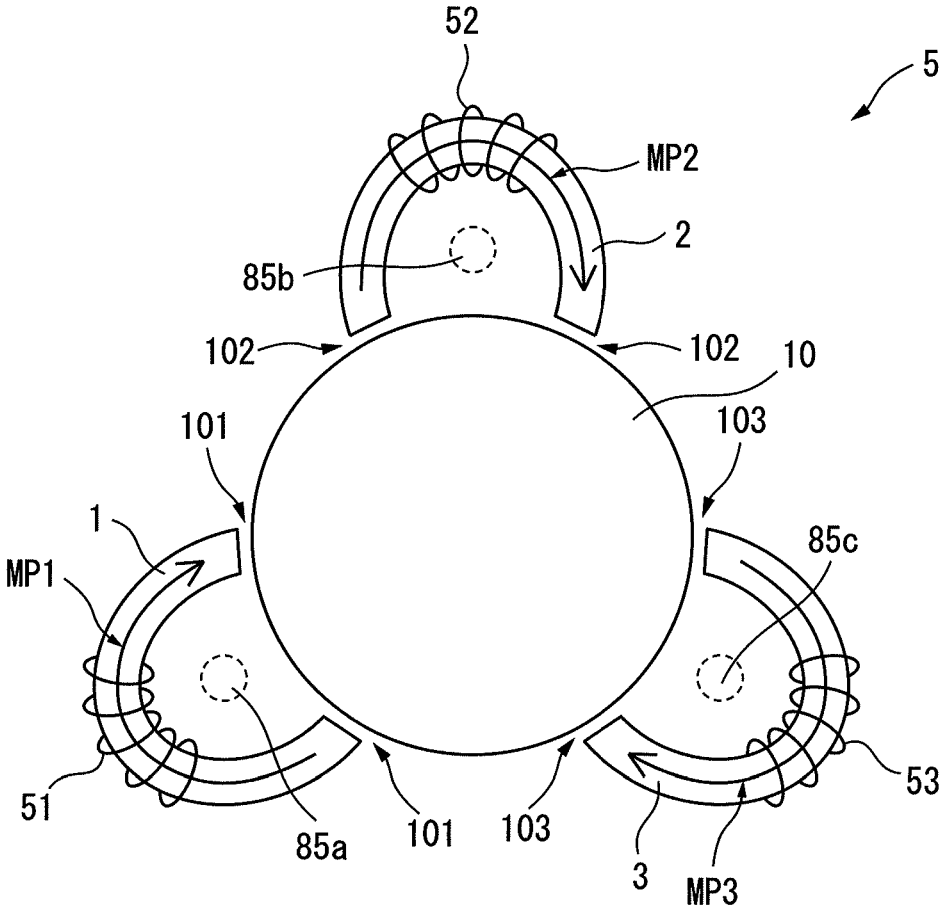
FIG. 5 is a third cross-sectional view of the core body.

Still further, the core body 5 may be the core body 5 having a cross section as illustrated in FIG. 5. In FIG. 5, the core body 5 includes the center portion iron core 10 having a circular shape. Then, iron cores 1-3 having a loop shape are disposed at equal intervals around the center portion iron core 10. As apparent from FIG. 5, the iron cores 1-3 correspond to a part of a circle or an ellipse or loop. In addition, on the iron cores 1-3, the coils 51-53 are wound, respectively.

As illustrated in FIG. 5, the iron cores 1-3 are disposed in such a manner that each of magnetic paths MP1, MP2, MP3 has a loop shape with respect to the center portion iron core 10. Further, between an outer side of the center portion iron core 10 and both ends of the respective iron cores 1-3, the gaps 101-103 are provided.

In terms of a magnetic circuit, when the gaps 101-103 are provided, normally, in the inductance of the reactor, a magnetic resistance of the gaps 101-103 is a dominant factor, and an inductance value is determined depending on the gaps 101-103. In general, up to a high current, the inductance value is constant. On the other hand, when the gaps 101-103 are made to be small or zero, in the inductance, a magnetic resistance of the iron and the electrical steel plates constituting the iron cores is a dominant factor, and in general, a primary target is use with a low current. In addition, a size largely differs as well.

Further, loop shapes of the iron cores 1-3 are identical to each other and distances between two adjacent iron cores (1 and 2, 2 and 3, 3 and 1) are equal to each other. In other words, the three iron cores 1-3 are disposed around the center portion iron core 10 to be rotationally symmetrical with respect to the center of the center portion iron core 10. Note that as the reactor, in view of providing the inductance, the loop shapes of the iron cores 1-3 may not be shapes identical to each other, and there is no physical problem without a rotationally symmetrical disposition. In addition, as a matter of course, there is no physical problem if the sizes of the gaps 101-103 are also not identical to each other with respect to the iron cores 1-3.

Referring to FIGS. 1 and 2 again, in the vicinity of an edge portion of the first end plate 81, a plurality of through holes 84*a*-84*c* are provided at equal intervals. A plurality of axis portions 85*a*-85*c* pass through the through holes 84*a*-84*c* of the first end plate 81, respectively. The plurality of axis portions 85*a*-85*c* may be screwed by screws 91*a*-91*c*, respectively. The axis portions 85*a*-85*c* are preferably made of a non-magnetic material, such as aluminum, SUS, or a resin. Further, a length of the axis portions 85*a*-85*c* is preferably greater than or equal to a length of the core body 5 in the axial direction. In addition, in the vicinity of an edge portion of the second end plate 82, through holes or recessed portions 86*a*-86*c* which respectively house tip ends of the axis portions 85*a*-85*c* are provided.

Further, as illustrated in FIGS. 1, 3 and 4, the outer circumference portion iron core 20 is provided with through holes 87*a*-87*c* at positions in accordance with positions of the through holes 84*a*-84*c* of the first end plate 81, respectively. The through holes 87*a*-87*c* are provided at positions in accordance with positions of the iron core coils 31-33 in the outer circumference portion iron core 20.

Accordingly, when the reactor 6 is assembled, the axis portions 85*a*-85*c* pass through the through holes 84*a*-84*c* of the first end plate 81 and the through holes 87*a*-87*c* of the outer circumference portion iron core 20 and are housed in the recessed portions 86*a*-86*c* of the second end plate 82, respectively. Thus, the core body 5 is firmly held through the axis portions 85*a*-85*c* between the first end plate 81 and the second end plate 82. Consequently, even while the reactor 6 drives, generation of noises and vibrations can be restrained. Note that the tip ends of the axis portions 85*a*-85*c* may be respectively coupled with the second end plate 82 by screws 92*a*-92*c* or the like, and it will be apparent that in such a case, noises and vibrations can be further restrained.

The axis portions 85*a*-85*c* are disposed at positions distant from the center of the core body 5, and the axis portions 85*a*-85*c* are made of a non-magnetic material. Thus, a magnetic field is not influenced by the axis portions 85*a*-85*c* even while the reactor 6 drives. Further, in the present invention, the coupling plates as described in the prior art are not to be used, which consequently enables easy control of a gap length.

In addition, the axis portions 85*a*-85*c* may be solid or hollow. When the axis portions 85*a*-85*c* are solid, the core body 5 can be firmly held. Further, it will be apparent that when the axis portions 85*a*-85*c* are hollow, the entirety of the reactor 6 can be configured to be light.

Note that when disposed through the core body 5 illustrated in FIG. 5 between the first end plate 81 and the second end plate 82, the axis portions 85*a*-85*c* are preferably made to pass through interior spaces of the iron cores 1-3, respectively. It will be apparent that also in such a case, substantially similar effects are obtained.

Figure 6:
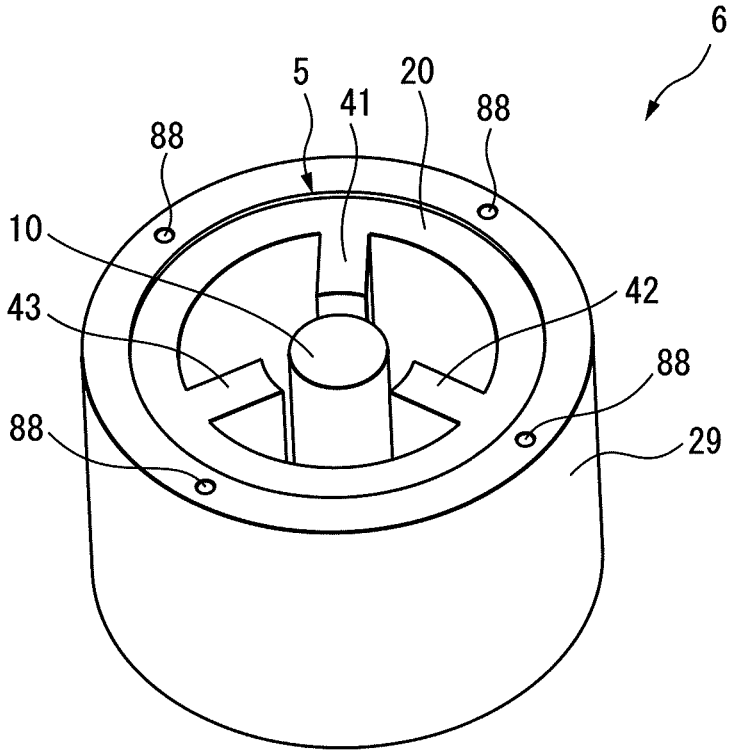
FIG. 6 is a perspective view illustrating a part of the reactor according to another embodiment of the present invention.

Further, FIG. 6 is a perspective view illustrating a part of the reactor according to another embodiment of the present invention. The core body 5 illustrated in FIG. 6 includes the center portion iron core 10, the outer circumference portion iron core 20 having a circular shape, and the iron cores 41-43. Note that to facilitate understanding, the coils 51-53 are unillustrated in FIG. 6.

Still further, the core body 5 is inserted in a cylindrical housing 29 having a shape in accordance with the outer circumference portion iron core 20. A certain gap between the core body 5 and the housing 29 is preferable. The housing 29 is preferably made of a non-magnetic material, such as aluminum, SUS, or a resin. As illustrated, end surfaces of the housing 29 are provided with a plurality of through holes 88 which extend in the axial direction. Note that it is assumed that when the core body 5 having a hexagonal cross section is used, the housing 29 has a similar cross section determined in accordance with the core body 5.

As illustrated in FIG. 6, the housing 29 is provided with the plurality of through holes 88. Into the through holes 88, the plurality of axis portions 85*a*-85*c* of the first end plate 81 are respectively inserted, so that between the first end plate 81 and the second end plate 82, the core body 5 and the housing 29 can be held. It is assumed that in such a case, the first end plate 81 and the second end plate 82 have a shape similar to that of the end surfaces of the housing 29, and the first end plate 81 is provided with the axis portions 85 in accordance with the through holes 88 of the housing 29. The recessed portions 86 provided to the second end plate 82 are similarly configured as well.

It will be apparent that also in such a case, the core body 5 in the housing 29 can be firmly held between the first end plate 81 and the second end plate 82. When the core body 5 disposed in the housing 29 is the core body 5 including the outer circumference portion iron core 20 as illustrated in FIGS. 3 and 4, the outer circumference portion iron core 20 is not to be provided with the through holes 87*a*-87*c*. Thus, lowering of a strength of the core body 5 can be avoided.

Further, by using the housing 29, the core body 5 failing to include an outer circumference portion iron core, such as the core body 5 illustrated in FIG. 5, can be firmly held. Thus, a configuration illustrated in FIG. 6 is particularly advantageous in a case of the core body 5 failing to include an outer circumference portion iron core.

Figure 7A:
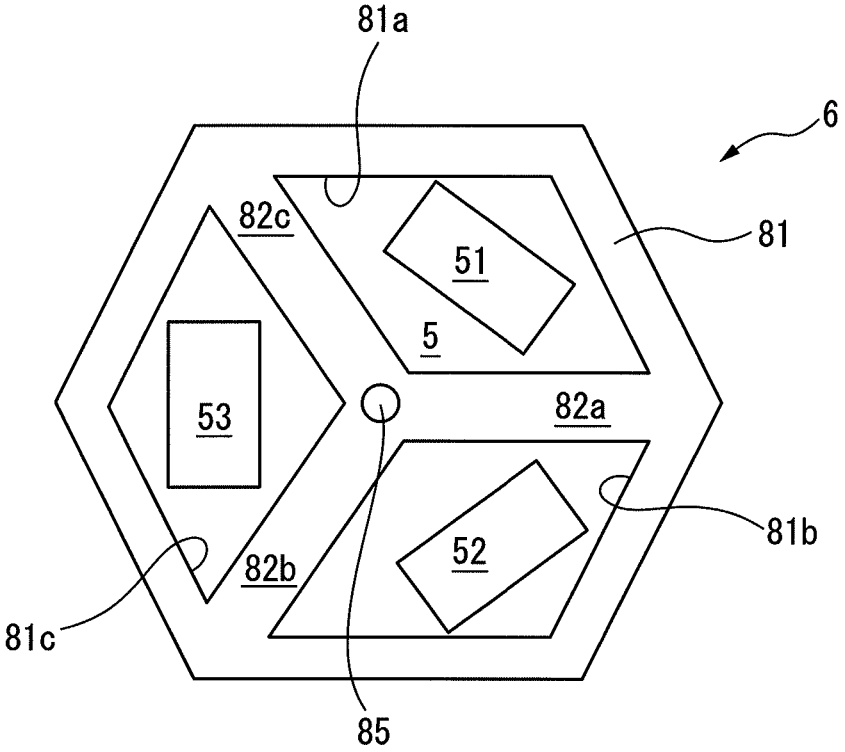
FIG. 7A is a top view of another reactor.

Further, FIG. 7A is a top view of another reactor. In an embodiment illustrated in FIG. 7A, the first end plate 81 includes a plurality of extension portions 82*a*-82*c* which extend toward the center thereof. Then, between the extension portions 82*a*-82*c* adjacent to each other, opening portions 81*a*-81*c* are provided. Then, the plurality of coils 51-53 are respectively positioned in regions of the opening portions 81*a*-81*c*.

Figure 7B:
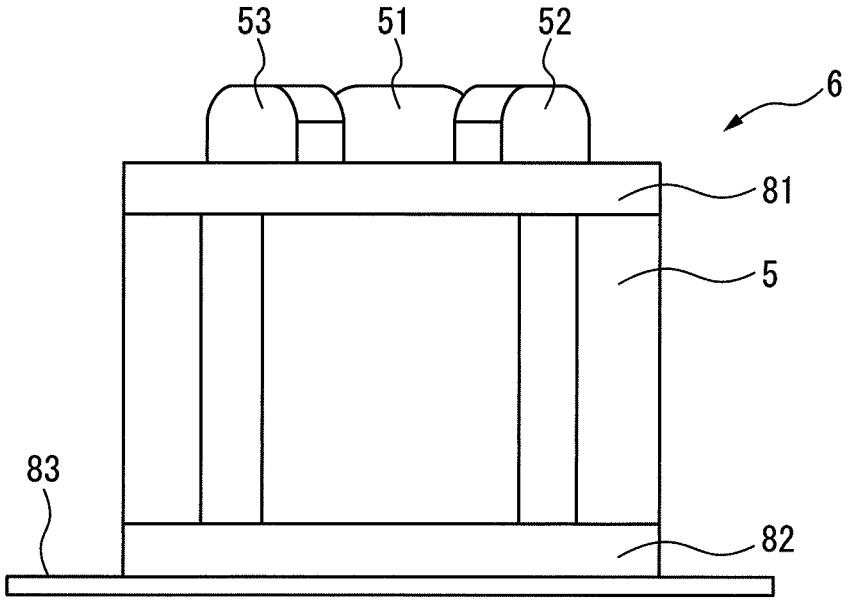
FIG. 7B is a side view of the reactor illustrated in FIG. 7A.
Figure 8:
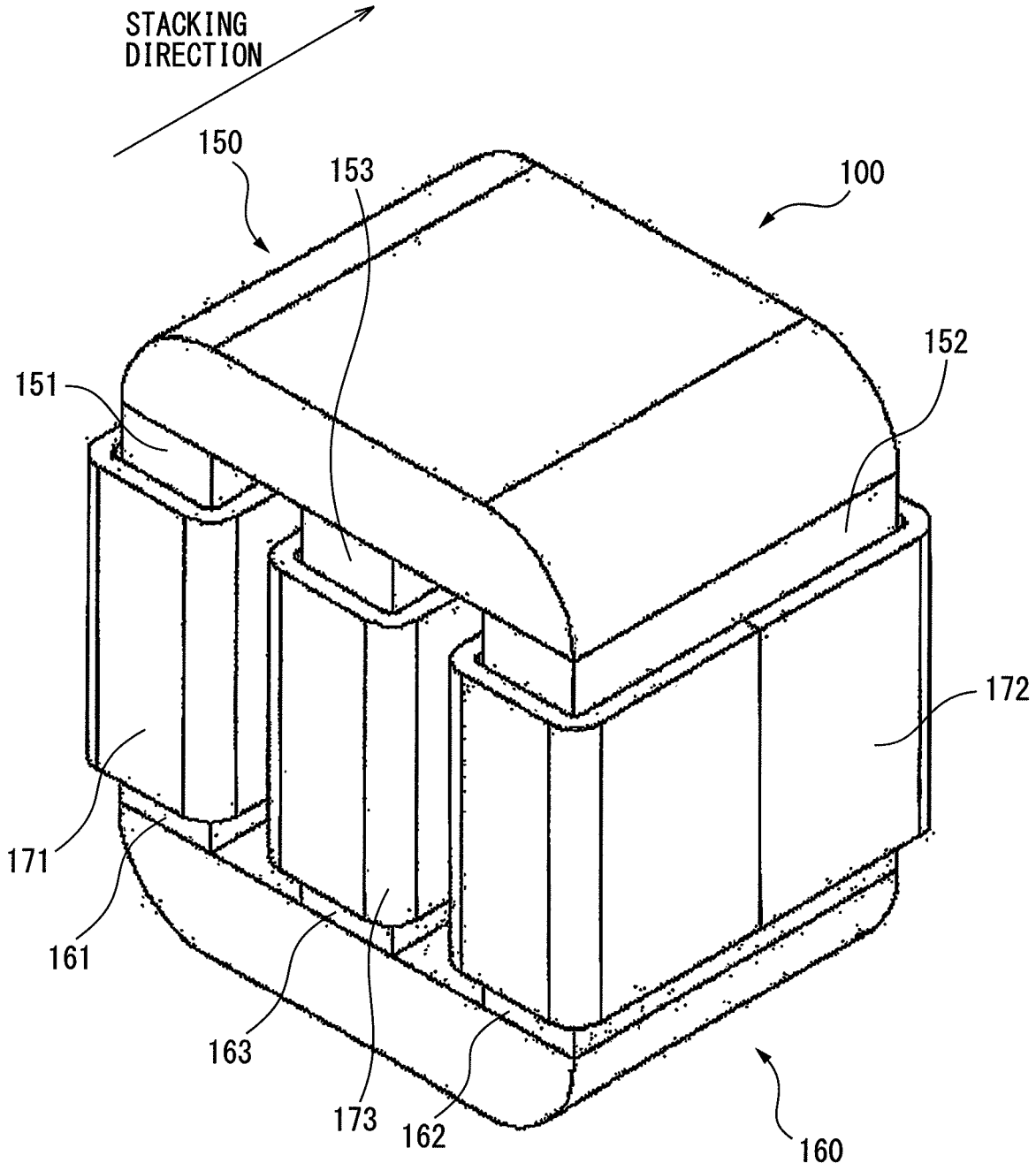
FIG. 8 is a perspective view of a reactor according to a conventional technique.
Figure 9:
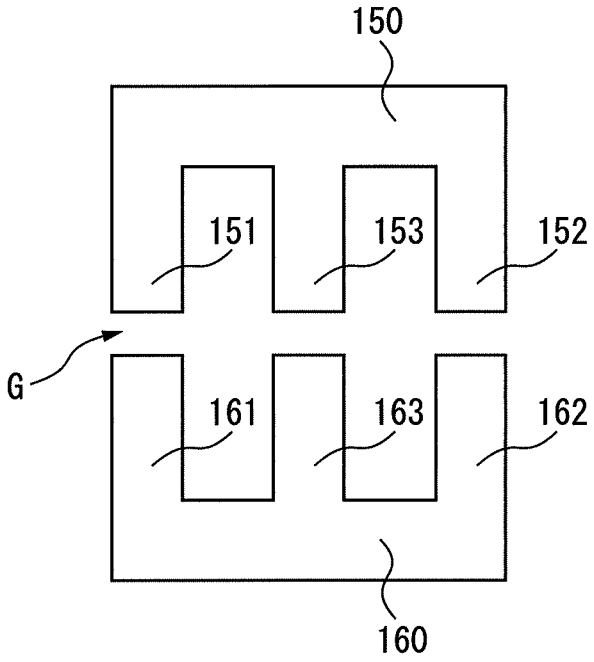
FIG. 9 is a diagram illustrating a first iron core and a second iron core of the reactor illustrated in FIG. 8.
Figure 10:
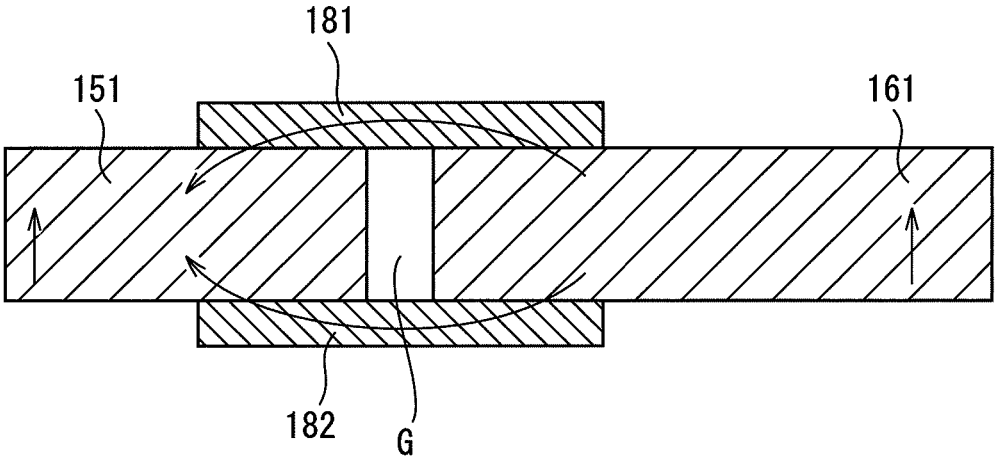
FIG. 10 is an enlarged side view of a gap.

Still further, FIG. 7B is a side view of the reactor illustrated in FIG. 7A. As apparent from FIGS. 7A and 7B, when the reactor 6 is assembled, the coils 51-53 partially pass through the respective opening portions 81*a*-81*c* and protrude from the outer surface of the first end plate 81. It will be apparent that in such a case, heat generated from the coils 51-53 can be air-cooled while the reactor 6 drives. Note that it may be also configured that the second end plate 82 is provided with similar opening portions and the coils partially protrude from an outer surface of the second end plate 82.

Figure 11A:
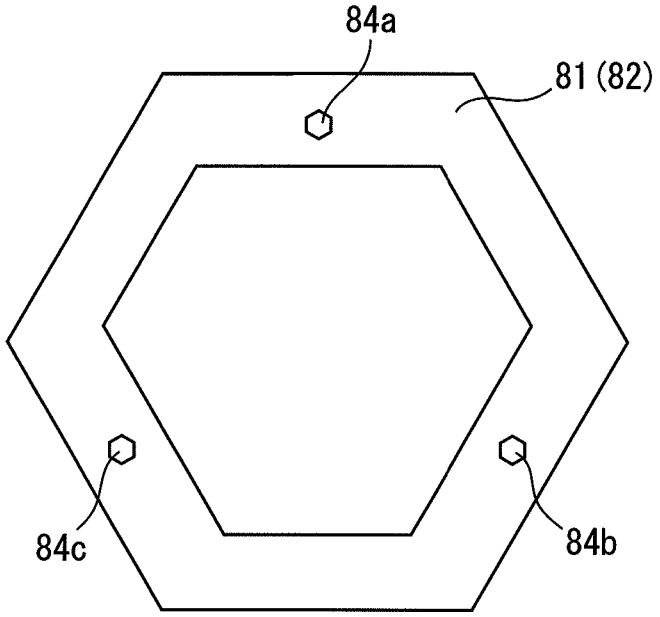
FIG. 11A is a top view of an end plate of the reactor according to still another embodiment.
Figure 11B:
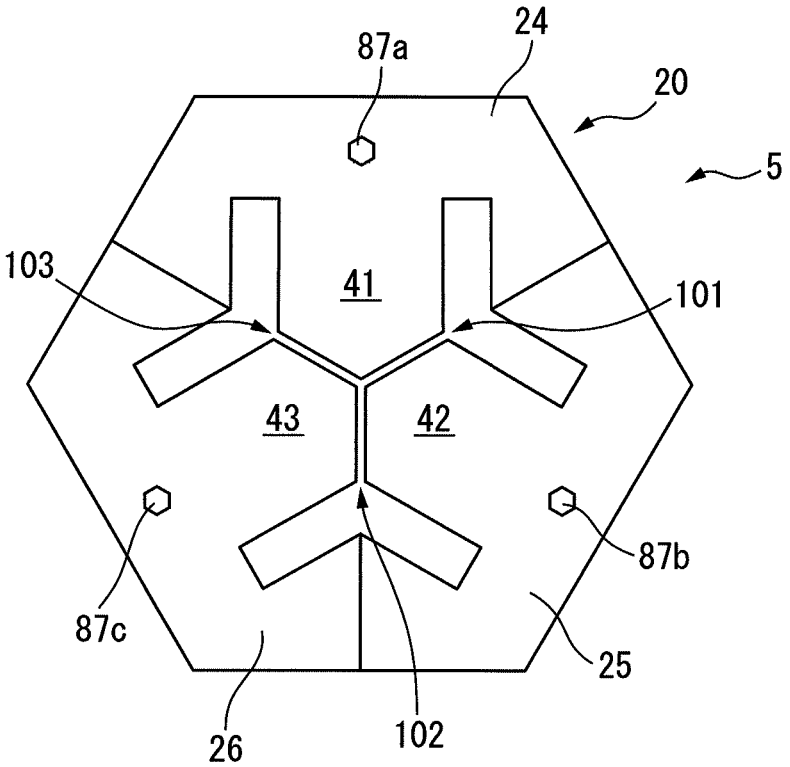
FIG. 11B is a top view of the reactor according to another embodiment.

FIG. 11A is a top view of the end plate of the reactor according to still another embodiment, and FIG. 11B is a top view of the reactor according to another embodiment. The first end plate 81 is illustrated in FIG. 11A, while it is assumed that the second end plate 82 also has a similar configuration. The through holes 84*a*-84*c* of the first end plate 81 according to another embodiment have a polygonal shape, such as a hexagonal shape. Then, through holes 87*a*-87*c* provided to the outer circumference portion iron core 20 also have a polygonal shape in accordance with the through holes 84*a*-84*c* of the first end plate 81.

Figure 11C:
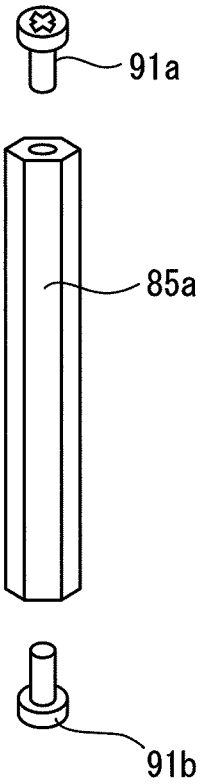

FIG. 11C is a perspective view of an axis portion applied to the reactor illustrated in FIG. 11B and the like. The axis portion 85*a* is illustrated in FIG. 11C, while it is assumed that the other axis portions 85*b* and 85*c* also have a similar configuration. A cross section of the axis portion 85*a* has a polygonal shape in accordance with the through holes 84*a*-84*c* and the like.

As apparent with reference to FIG. 1, the axis portions 85*a*-85*c* having a polygonal cross section are inserted into the first end plate 81, the core body 5, and the second end plate 82. Then, as described above, both end portions of the axis portions 85*a*-85*c* are screwed with the screws 91*a*-91*c* and the screws 92*a*-92*c*. In such a case, the axis portions 85*a*-85*c* have a polygonal shape, so that the axis portions 85*a*-85*c* fail to rotate while being screwed. Thus, the core body 5 can be further firmly supported. Further, automation of a manufacturing process is also facilitated.

EFFECTS OF THE ASPECTS

In the first aspect, the plurality of axis portions couple the first end plate and the second end plate, so that the reactor can be suitably supported. Further, the axis portions are distant from the center of the reactor so that an influence on a magnetic field by the axis portions can be avoided. In addition, using a coupling plate is not necessary, so that control of a gap length is also easy.

In the second aspect, rotation of the axis portions can be avoided and automation of manufacturing can be facilitated.

In the third aspect, the core body can be firmly supported.

In the fourth aspect, the entirety of the reactor can be configured to be light.

In the fifth aspect, the coils are enclosed by the outer circumference portion iron core, so that occurrence of leakage of magnetic flux can be avoided. In addition, when the center portion iron core is not necessary, the entirety of the core body can be configured to be light.

In the sixth aspect, the coils protrude further outward than at least one of the first end plate and the second end plate, so that coil cooling effects can be enhanced.

In the seventh aspect, the non-magnetic material which composes the axis portions, the first end plate, and the second end plate is preferably, for example, aluminum, SUS, a resin, or the like, thereby allowing a magnetic field to avoid passing the axis portions, the first end plate, and the second end plate.

In the eighth aspect, the core body can be firmly held.

In the ninth aspect, even the core body failing to include the outer circumference portion iron core can firmly hold the core body. Further, in a case of the core body including the outer circumference portion iron core, providing a through hole to the outer circumference portion iron core is not necessary and strength can be maintained.

In the tenth aspect, the inductance of each phase can be aligned to a constant value.

In the eleventh aspect, the coil protrudes further outward than at least one of the first end plate and the second end plate, so that coil cooling effects can be enhanced.

In the twelfth aspect, the non-magnetic material which composes the axis portions, the first end plate, and the second end plate is preferably, for example, aluminum, SUS, a resin, or the like, thereby allowing a magnetic field to avoid passing the axis portions, the first end plate, and the second end plate.

In the thirteenth aspect, the core body can be firmly held.

In the fourteenth aspect, even the core body failing to include the outer circumference portion iron core can firmly hold the core body. Further, in a case of the core body including the outer circumference portion iron core, providing a through hole to the outer circumference portion iron core is not necessary and strength can be maintained.

Typical embodiments have been used to describe the present aspects, but a person skilled in the art would understand that the above-mentioned changes and various other changes, deletions, and additions can be made without departing from the scope of the present aspects. In addition, suitable combinations of some embodiments as described above are included in the scope of the present aspects.

What is claimed is:

1. A reactor comprising:
- a core body;
- a first end plate and a second end plate which sandwich and fasten the core body; and
- a plurality of axis portions disposed in the vicinity of an outer edge portion of the core body and supported by the first end plate and the second end plate, wherein
- the core body comprises:
  - an outer circumference portion iron core,
  - at least three iron cores which contact or are coupled to an inner surface of the outer circumference portion iron core, and
  - coils which are wound around the at least three iron cores,
- gaps are formed between two adjacent iron cores of the at least three iron cores or between the at least three iron cores and a center iron core arranged in a center of the core body, through which gaps the iron cores are magnetically connectable, and
- the plurality of axis portions pass through an interior of the outer circumference portion iron core.

2. The reactor according to claim 1, wherein cross-sections of the axis portions are polygonal or cylindrical.

3. The reactor according to claim 1, wherein the axis portions are solid.

4. The reactor according to claim 1, wherein the axis portions are hollow.

5. A reactor, comprising:
- a core body,
- a first end plate and a second end plate which sandwich and fasten the core body, and
- a plurality of axis portions disposed in the vicinity of an outer edge portion of the core body and which are supported by the first end plate and the second end plate, wherein
- the core body comprises:
  - a center iron core arranged in a center of the core body,
  - a plurality of iron cores which are arranged on an outside of the center iron core so that a magnetic path relative to the center iron core becomes loop-shaped, and
  - one or a plurality of coils which are wound around each of the plurality of iron cores,
- gaps are formed between the center iron core and the plurality of iron cores, through which gaps the iron cores are magnetically connectable,
- each of the plurality of iron cores constitutes a part of a circle or an ellipse, and
- the plurality of axis portions are arranged inside the iron cores.

6. The reactor according to claim 5, wherein
- at least one of the first end plate and the second end plate is provided with an opening portion, and
- the one or a plurality of coils pass through the opening portion of at least one of the first end plate and the second end plate and protrude further outward than at least one of the first end plate and the second end plate.

7. The reactor according to claim 5, wherein at least one of the axis portions, the first end plate, and the second end plate is made of a non-magnetic material.

8. The reactor according to claim 1, wherein the first end plate and the second end plate are in contact with the outer circumference portion iron core over an entire edge portion of the outer circumference portion iron core.

9. A reactor, comprising:

a core body, a first end plate and a second end plate which sandwich and fasten the core body, and a plurality of axis portions arranged outside of the core body and supported by the first end plate and the second end plate, wherein the core body comprises:

a center iron core arranged in a center of the core body, a plurality of iron cores which are arranged outside the center iron core so that a magnetic path relative to the center iron core becomes loop-shaped, and one or a plurality of coils which are wound around each of the plurality of iron cores, gaps are formed between the center iron core and the plurality of iron cores, through which gaps the iron cores are magnetically connectable, the plurality of axis portions are arranged outside the iron core, the reactor further comprises a housing surrounding the core body, and the plurality of axis portions pass through the housing.

10. A reactor, comprising:

a core body, a first end plate and a second end plate which sandwich and fasten the core body, and a plurality of axis portions which are arranged outside of the core body and supported by the first end plate and the second end plate, wherein the core body comprises:

an outer circumference portion iron core;

at least three iron cores which contact an inner surface of the outer circumference iron core or which are coupled to the inner surface, and three coils which are wound around the at least three iron cores, gaps are formed between two adjacent iron cores of the at least three iron cores or between the at least three iron cores and a center iron core arranged in a center of the core body, through which gaps the iron cores are magnetically connectable, the reactor further comprising a housing which surrounds the core body, and the plurality of axis portions pass through the housing.

11. The reactor according to claim 1, wherein at least one of the first end plate and the second end plate is provided with an opening portion, and the coils pass through the opening portion of at least one of the first end plate and the second end plate and protrude further outward than at least one of the first end plate and the second end plate.

12. The reactor according to claim 1, wherein at least one of the axis portions, the first end plate, and the second end plate is made of a non-magnetic material.

* * * * *